US009972953B1

(12) United States Patent
Zamora et al.

(10) Patent No.: US 9,972,953 B1
(45) Date of Patent: May 15, 2018

(54) PUSH-TYPE CONNECTOR FOR ELECTRICAL CONDUCTORS

(71) Applicant: Viza Electronics Pte. Ltd., Charlotte, NC (US)

(72) Inventors: Robert Zamora, Huntersville, NC (US); Chi Fai Andrew Ho, Kowloon (HK); Simon Christopher Smith, Benfleet (GB)

(73) Assignee: Viza Electronics Pte. Ltd., Charlotte, NC (US)

( * ) Notice: Subject to any disclaimer, the term of this patent is extended or adjusted under 35 U.S.C. 154(b) by 0 days. days.

(21) Appl. No.: 15/646,898

(22) Filed: Jul. 11, 2017

(51) Int. Cl.

| | |
|---|---|
| ***H01R 13/56*** | (2006.01) |
| ***H01R 24/62*** | (2011.01) |
| ***H01R 13/24*** | (2006.01) |
| ***H01R 13/26*** | (2006.01) |
| ***H01R 13/415*** | (2006.01) |
| ***H01R 13/516*** | (2006.01) |
| *H01R 101/00* | (2006.01) |
| *H01R 103/00* | (2006.01) |
| *H01R 105/00* | (2006.01) |
| *H01R 107/00* | (2006.01) |

(52) U.S. Cl.
CPC ..... *H01R 24/62* (2013.01); *H01R 13/2464* (2013.01); *H01R 13/26* (2013.01); *H01R 13/415* (2013.01); *H01R 13/516* (2013.01); *H01R 2101/00* (2013.01); *H01R 2103/00* (2013.01); *H01R 2105/00* (2013.01); *H01R 2107/00* (2013.01)

(58) Field of Classification Search
CPC ..... H01R 2107/00; H01R 2105/00; H01R 2103/00; H01R 2101/00; H01R 13/516; H01R 13/415; H01R 13/26; H01R 13/2464; H01R 24/62
USPC ..... 439/483, 284, 441, 835, 58, 88, 295
See application file for complete search history.

(56) References Cited

U.S. PATENT DOCUMENTS

| | | | | |
|---|---|---|---|---|
| 3,091,746 | A * | 5/1963 | Winkler | H01R 24/84 439/295 |
| 3,452,321 | A * | 6/1969 | Carissimi | H01R 13/46 331/107 G |
| 3,794,957 | A * | 2/1974 | Winkler | H01R 13/28 439/170 |

(Continued)

*Primary Examiner* — Abdullah Riyami
*Assistant Examiner* — Nelson R Burgos-Guntin
(74) *Attorney, Agent, or Firm* — Lee & Hayes, PLLC

(57) ABSTRACT

A connector may be configured to electrically connect at least first and second electrical conductors to one another. The connector may include first and second connector elements configured to electrically couple the first and second electrical conductors. The first and second connector elements may each include tubular members extending longitudinally between respective conductor ends and connector ends. The tubular members may each define respective exterior surfaces. The exterior surfaces of the first and second connector elements may define respective body portions, and the exterior surface of the first connector element may define a projection. The exterior surface of the second connector element may define a tubular receiver configured to receive the projection. The exterior surfaces may include respective shoulders, and the exterior surfaces may each define a plurality of transverse ridges associated with the respective shoulders to facilitate gripping the first and second connector elements.

24 Claims, 6 Drawing Sheets

(56) References Cited

U.S. PATENT DOCUMENTS 3,909,099 A * 9/1975 Winkler ..... H01R 13/562 439/295
4,386,818 A * 6/1983 Millhimes ..... H01R 13/7175 439/483
4,455,056 A * 6/1984 Herrmann, Jr. ..... H01R 13/53 439/284
4,884,981 A * 12/1989 Chandler ..... H01R 13/6593 439/284
4,990,099 A * 2/1991 Marin ..... H01R 13/642 439/284
6,220,891 B1 * 4/2001 Hils ..... H01R 13/6598 439/284
7,420,119 B2 * 9/2008 Janos ..... H01R 25/003 174/53
7,628,640 B2 * 12/2009 Radle ..... H01R 4/5008 439/441
7,727,002 B2 * 6/2010 Bethurum ..... H01R 4/4818 439/441
7,753,718 B2 * 7/2010 Bethurum ..... H01R 4/4818 439/293
8,187,023 B1 * 5/2012 Chen ..... H01R 4/22 439/439
8,454,378 B2 * 6/2013 Osterhart ..... H01R 13/4223 439/284
2003/0017741 A1 * 1/2003 Olson ..... G02B 6/3878 439/483
2008/0132109 A1 * 6/2008 Landis ..... H01R 13/639 439/441
2008/0280475 A1 * 11/2008 Byrne ..... H01R 25/162 439/284
2010/0130042 A1 * 5/2010 Gray ..... H01R 4/4818 439/176
2011/0028016 A1 * 2/2011 Toner ..... H01R 24/84 439/284
2012/0088386 A1 * 4/2012 Guo ..... H01R 12/73 439/284
2015/0194745 A1 * 7/2015 Moser ..... H01R 4/4836 439/55

* cited by examiner

PUSH-TYPE CONNECTOR FOR ELECTRICAL CONDUCTORS

BACKGROUND

Electrical connectors are often used to provide a convenient and secure way to electrically couple two more electrical conductors to one another. For example, some electrical connectors may include a first part for coupling to a first electrical conductor and a second part for coupling to a second electrical conductor, and the two parts of the connector may be designed to be connected to each other so that the first and second electrical conductors are electrically coupled to one another. Some connectors may be designed for connection and disconnection without tools, and some connectors may provide a more secure connection than other types of electrical connection, such as those that use wire nuts and/or electrical tape. In addition, some connectors may be designed to comply with various certifications set by certification organizations, such as Underwriters Laboratories (UL) and Canadian Standards Association (CSA), which may establish standards for various characteristics of the connector.

BRIEF DESCRIPTION OF THE DRAWINGS

The detailed description is described with reference to the accompanying figures. The same reference numbers in different figures indicate similar or identical items.

DETAILED DESCRIPTION

Figure 1A:
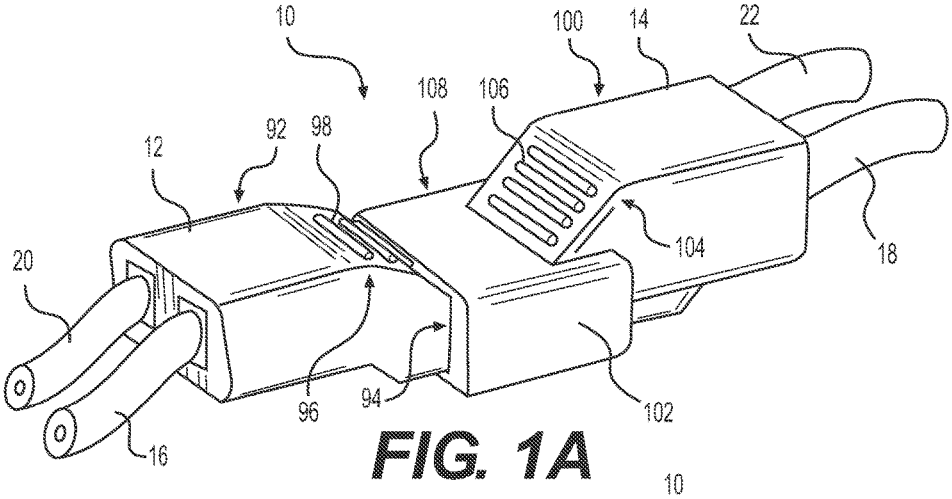
FIG. 1A is a schematic, perspective view of an example connector for electrically connecting conductors to one another.

This disclosure is generally directed to connectors for electrically connecting two or more electrical conductors to one another. As discussed above, electrical connectors are often used to provide a convenient and secure way to electrically couple two more electrical conductors to one another. The connectors disclosed herein may facilitate connection of the electrical conductors without tools, and may provide a more secure connection than other types of electrical connection. In addition, some connectors disclosed herein may comply with some certifications set by UL, CSA, and/or other certification organizations.

In some examples, the connector may be configured to connect at least a first electrical conductor and a second electrical conductor to one another. The electrical conductors may be, for example, insulated wires or any other similar known electrical conductors. The connector may include a first connector element configured to receive a first electrical conductor and electrically couple the first electrical conductor to a second electrical conductor, and a second connector element configured to receive a second electrical conductor and electrically couple the second electrical conductor to the first electrical conductor. The first connector element may include a first tubular member including an electrically insulating material and extending longitudinally between a first conductor end configured to receive the first electrical conductor and a first connector end configured to be coupled to a second connector element. The first tubular member may define a first exterior surface and a first interior. The first connector element may also include a first contact element coupled to the first interior of the first connector element. The first contact element may be configured to anchor the first electrical conductor in the first interior and electrically couple the first electrical conductor to the second electrical conductor. The first exterior surface may define a first body portion and a projection configured to be received by the second connector element. The first body portion and the projection may be coupled to one another at a first shoulder, and the first exterior surface may define a plurality of transverse ridges associated with the first shoulder and configured to facilitate gripping the first connector element.

The second connector element may include a second tubular member including an electrically insulating material and extending longitudinally between a second conductor end configured to receive the second electrical conductor and a second connector end configured to be coupled to the first connector element. The second tubular member may define a second exterior surface and a second interior. The connector element may also include a second contact element coupled to the second interior of the second connector element. The second contact element may be configured to anchor the second electrical conductor in the second interior and electrically couple the second electrical conductor to the first electrical conductor. The second exterior surface may define a second body portion and a tubular receiver configured to receive the projection of the first connector element. The second body portion and the tubular receiver may be coupled to one another at a second shoulder, and the second exterior surface may define a plurality of transverse ridges associated with the second shoulder and configured to facilitate gripping the second connector element.

In some examples, the transverse ridges of the first and second connector elements may provide a gripping surface that renders it easier to connect and/or disconnect the first and second connector elements to and/or from one another, thereby facilitating ease of connection and/or disconnection of the first and second electrical conductors to and/or from one another. In some examples, the first and second exterior surfaces may define a recess between the first and second shoulders of the first and second connector elements when the projection of the first connector element is received in the tubular receiver of the second connector element. In some examples, the recess may provide clearance for fingers to access the transverse ridges, for example, to provide an improved grip for connecting and/or disconnecting the first and second connector elements to and/or from one another.

In some examples, the projection of the first connector element may define an exterior cross-section, and the tubular receiver of the second connector element may define an interior cross-section. The exterior cross-section and the interior cross-section may be configured such that the exterior cross-section is received in the interior cross-section when the projection of the first connector element is received in the tubular receiver of the second connector element. The exterior cross-section of the projection may define a longitudinal mating recess, and the interior cross-section of the tubular receiver may define a longitudinal mating extension. The mating extension may be received in the mating recess when the projection of the first connector element is received in the tubular receiver of the second connector element. In some examples, the exterior cross-section of the projection may be rectangular, and the interior cross-section of the tubular receiver may be rectangular.

In some examples, the projection of the first connector element may define a tubular interior, and the first contact element may extend into the tubular interior of the projection. The second contact element of the second connector element may extend into the interior cross-section of the tubular receiver, and the first contact element and the second contact element may be electrically coupled to one another when the projection of the first connector element is received in the tubular receiver of the second connector element.

In some examples, the first connector element may include a third contact element coupled to the first interior of the first connector element. The third contact element may be configured to anchor a third electrical conductor in the first interior and electrically couple the third electrical conductor to a fourth electrical conductor associated with the second connector element when the projection of the first connector element is received in the tubular receiver of the second connector element. The second connector element may include a fourth contact element coupled to the second interior of the second connector element. The fourth contact element may be configured to anchor a fourth electrical conductor in the second interior and electrically couple the fourth electrical conductor to the third electrical conductor when the projection of the first connector element is received in the tubular receiver of the second connector element.

In some examples, the projection of the first connector element may define a first exterior cross-section and a second exterior cross-section, and the tubular receiver of the second connector element may define a first interior cross-section and a second interior cross-section. The first exterior cross-section and the first interior cross-section may be configured such that the first exterior cross-section is received in the first interior cross-section, and the first contact element of the first connector element and the second contact element of the second connector element are electrically coupled to one another, when the projection of the first connector element is received in the tubular receiver of the second connector element. The second exterior cross-section and the second interior cross-section may be configured such that the second exterior cross-section is received in the second interior cross-section, and the third contact element of the first connector element and the fourth contact element of the second connector element are electrically coupled to one another, when the projection of the first connector element is received in the tubular receiver of the second connector element.

In some examples, the first exterior cross-section and the second exterior cross-section of the projection of the first connector element may be coupled to one another via a longitudinal web extending between the first exterior cross-section and the second exterior cross-section. The first interior cross-section and the second interior cross-section of the tubular receiver of the second connector element may define a longitudinal passage extending between the first interior cross-section and the second interior cross-section. The longitudinal passage may be configured receive the longitudinal web when the projection of the first connector element is received in the tubular receiver of the second connector element. In some examples, the longitudinal web may provide electrical insulation between the first and third contact elements of the first connector element, which may be located in the projection of first connector element, for example, in the first and second exterior cross-sections. This may be beneficial in preventing electrical shorting between the first and third contact elements. In some examples, the longitudinal web may provide electrical insulation between the second contact element and the fourth contact element of the second connector element when the longitudinal web is received in the longitudinal passage. This may be beneficial in preventing shorting between the second and fourth contact elements.

In some examples, the longitudinal web may provide structural reinforcement between the first and second exterior cross-sections. This may prevent the first and second exterior cross-sections from deflecting relative to one another, which may improve the ease of connection and/or disconnection of the projection of the first connector element to and/or from the tubular receiver of the second connector element. In some examples, the longitudinal web has an hourglass-shaped cross-section.

In some examples, a connector may be configured to electrically connect at least a first electrical conductor and a second electrical conductor to one another, and electrically connect at least a third electrical conductor and a fourth electrical conductor to one another. The connector may include a first connector element configured to receive a first electrical conductor and a third electrical conductor, and electrically couple the first electrical conductor to a second electrical conductor and electrically couple the third electrical conductor to a fourth electrical conductor. The connector may also include a second connector element configured to receive a second electrical conductor and a fourth electrical conductor, and electrically couple the second electrical conductor to the first electrical conductor and electrically couple the fourth electrical conductor to the third electrical conductor.

In some examples, the first connector element may include a first tubular member including an electrically insulating material and extending longitudinally between a first conductor end configured to receive the first and third electrical conductors, and a first connector end configured to be coupled to the second connector element. The first tubular member may define a first exterior surface and a first interior. The first connector element may also include a first contact element coupled to the first interior of the first connector element. The first contact element may be configured to anchor the first electrical conductor in the first interior and electrically couple the first electrical conductor to the second electrical conductor. The first connector element may also include a third contact element coupled to the first interior of the first connector element. The third contact element may be configured to anchor the third electrical conductor in the first interior and electrically couple the third electrical conductor to the fourth electrical conductor. The first exterior surface may define a first body portion and a projection configured to be received by the second connector element.

In some examples, the second connector element may include a second tubular member including an electrically insulating material and extending longitudinally between a second conductor end configured to receive the second and fourth electrical conductors, and a second connector end configured to be coupled to the first connector element. The second tubular member may define a second exterior surface and a second interior. The second connector element may also include a second contact element coupled to the second interior of the second connector element. The second contact element may be configured to anchor the second electrical conductor in the second interior and electrically couple the second electrical conductor to the first electrical conductor. The second connector element may further include a fourth contact element coupled to the second interior of the second connector element. The fourth contact element may be configured to anchor the fourth electrical conductor in the second interior and electrically couple the fourth electrical conductor to the third electrical conductor.

In some examples, the projection of the first connector element may define a first exterior cross-section and a second exterior cross-section, and the tubular receiver of the second connector element may define a first interior cross-section and a second interior cross-section. The first exterior cross-section and the first interior cross-section may be configured such that the first exterior cross-section is received in the first interior cross-section, and the first contact element of the first connector element and the second contact element of the second connector element are electrically coupled to one another, when the projection of the first connector element is received in the tubular receiver of the second connector element. The second exterior cross-section and the second interior cross-section may be configured such that the second exterior cross-section is received in the second interior cross-section, and the third contact element of the first connector element and the fourth contact element of the second connector element are electrically coupled to one another, when the projection of the first connector element is received in the tubular receiver of the second connector element. The first exterior cross-section and the second exterior cross-section of the projection of the first connector element may be coupled to one another via a longitudinal web extending between the first exterior cross-section and the second exterior cross-section.

In some examples, the first interior cross-section and the second interior cross-section of the tubular receiver of the second connector element may define a longitudinal passage extending between the first interior cross-section and the second interior cross-section. The longitudinal passage may be configured receive the longitudinal web when the projection of the first connector element is received in the tubular receiver of the second connector element. In some examples, the longitudinal web may provide electrical insulation between the first contact element and the third contact element of the first connector element. In some examples, the longitudinal web may provide electrical insulation between the second contact element and the fourth contact element of the second connector element when the longitudinal web is received in the longitudinal passage.

In some examples, a connector may be configured to receive a first electrical conductor and a third electrical conductor, and electrically couple the first electrical conductor to a second electrical conductor and electrically couple the third electrical conductor to a fourth electrical conductor. The connector element may include a tubular member including an electrically insulating material and extending longitudinally between a conductor end configured to receive the first and third electrical conductors, and a connector end configured to be coupled to a second connector element. The tubular member may define an exterior surface and an interior. The connector element may also include a first contact element coupled to the interior of the connector element. The first contact element may be configured to anchor the first electrical conductor in the interior and electrically couple the first electrical conductor to the second electrical conductor. The connector element may further include a second contact element coupled to the interior of the connector element. The second contact element may be configured to anchor the third electrical conductor in the interior and electrically couple the third electrical conductor to the fourth electrical conductor. The exterior surface may define a body portion and a projection configured to be received by the second connector element. The projection of the connector element may define a first exterior cross-section and a second exterior cross-section. The first exterior cross-section and the second exterior cross-section of the projection of the connector element may be coupled to one another via a longitudinal web extending between the first exterior cross-section and the second exterior cross-section.

In some examples, the longitudinal web may provide electrical insulation between the first contact element and the second contact element of the connector element. In some examples of the connector element, the longitudinal web may have an hourglass-shaped cross-section. In some examples, the body portion and the projection may be coupled to one another at a shoulder, and the exterior surface may define a plurality of transverse ridges associated with the shoulder and configured to facilitate gripping the connector element.

In some examples, a connector element may be configured to receive a first electrical conductor and a third electrical conductor, and electrically couple the first electrical conductor to a second electrical conductor and electrically couple the third electrical conductor to a fourth electrical conductor. The connector element may include a tubular member including an electrically insulating material and extending longitudinally between a conductor end configured to receive the first and third electrical conductors, and a connector end configured to be coupled to a second connector element. The tubular member may define an exterior surface and an interior. The connector element may also include a first contact element coupled to the interior of the connector element. The first contact element may be configured to anchor the first electrical conductor in the interior and electrically couple the first electrical conductor to the second electrical conductor. The connector element may further include a second contact element coupled to the interior of the connector element. The second contact element may be configured to anchor the third electrical conductor in the interior and electrically couple the third electrical conductor to the fourth electrical conductor. The exterior surface may define a body portion and a tubular receiver configured to receive a projection from the second connector element. The tubular receiver may define a first interior cross-section and a second interior cross-section. The first interior cross-section and the second interior cross-section of the tubular receiver may define a longitudinal passage extending between the first interior cross-section and the second interior cross-section.

FIG. 1A is a schematic, perspective view of an example connector 10 for electrically connecting electrical conductors to one another. For example, the connector 10 includes a first connector element 12 and a second connector element 14 configured to be coupled together and electrically connect the electrical conductors together. In the example shown in FIGS. 1A-1D, the first connector element 12 receives a first electrical conductor 16, and the second connector element 14 receives a second electrical conductor 18, and when the first and second connector elements 12 and 14 are coupled to one another, for example, by pushing the first connector 12 into the second connector 14, the respective first and second electrical conductors 16 and 18 are electrically coupled to one another, as explained in more detail herein. In some examples, such as the example shown in FIGS. 1A and 1B, the connector 10 is a two-pole connector configured to electrically couple the first and second electrical conductors 16 and 18 to one another, and to electrically couple a third electrical conductor 20 to a fourth electrical conductor 22 to one another. In particular, in addition to receiving the first electrical conductor 16, the first connector element 12 is also configured to receive the third electrical conductor 20, and in addition to receiving the second electrical conductor 16, the second connector element 14 is also configured to receive the fourth electrical conductor 22. Thus, in this example, the connector 10 is configured to electrically couple the first and second electrical conductors 16 and 18 to one another, and to electrically couple the third and fourth electrical conductors 20 and 22 to one another. Although the example connector 10 shown is configured to couple two pairs of electrical conductors to one another, connectors that couple a single pair of electrical conductors to one another (i.e., a single-pole connector), and connectors that couple more than two pairs of electrical conductors to one another (e.g., three- or more-pole connectors) are contemplated.

Figure 1B:
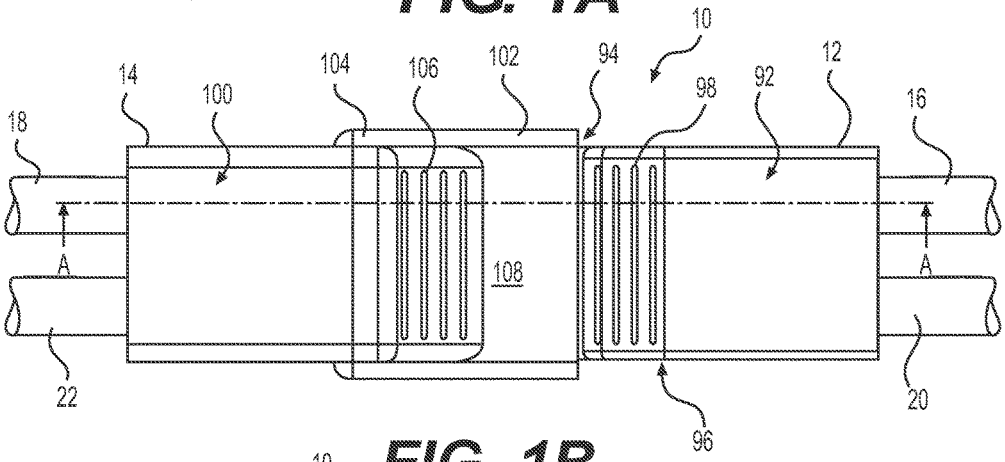
FIG. 1B is a schematic, top view of the example connector shown in FIG. 1A.
Figure 1C:
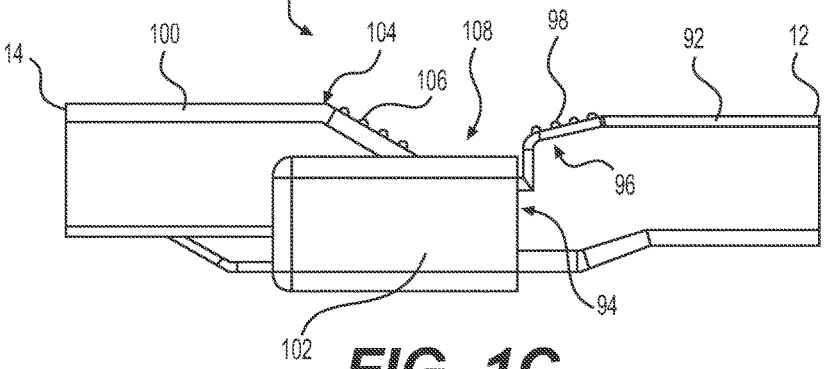
FIG. 1C is a schematic, side view of the example connector shown in FIG. 1B.
Figure 1D:
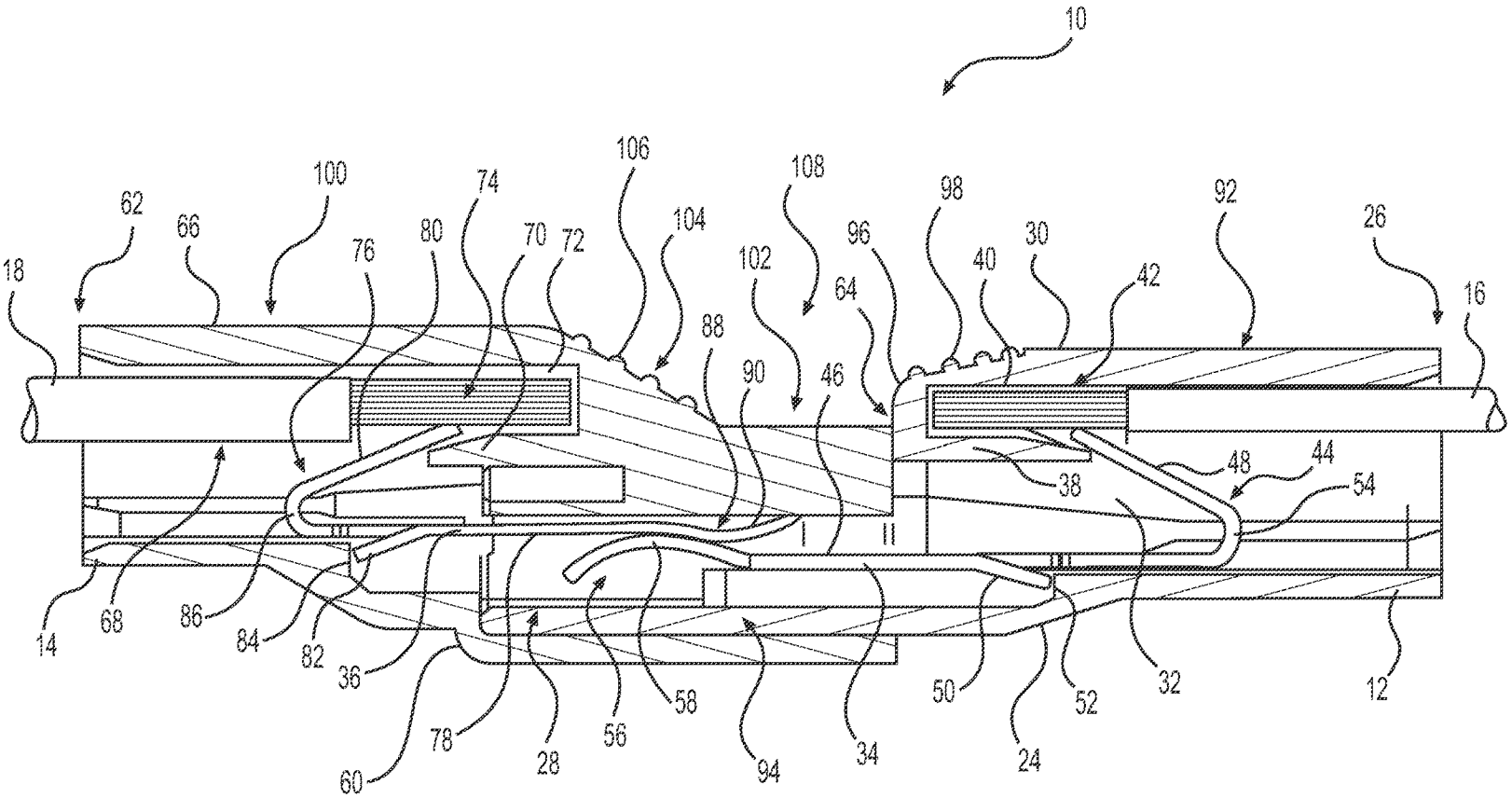
FIG. 1D is a schematic, partial side section view of the example connector shown in FIGS. 1A-1C taken along line A-A of FIG. 1B.

FIG. 1D is a schematic, partial side section view of the example connector 10 shown in FIGS. 1A-1C taken along line A-A of FIG. 1B. As shown in FIG. 1D, the first connector element 12 is a male connector configured to be received by the second connector element 14, which is a female connector. In the example shown, the first connector element 12 is configured to receive the first electrical conductor 16 and electrically couple the first electrical conductor 16 to the second electrical conductor 18. The first connector element 12 includes a first tubular member 24 formed from an electrically insulating material and extending longitudinally between a first conductor end 26 configured to receive the first electrical conductor 16 and a first connector end 28 configured to be coupled to the second connector element 14. The electrically insulating material may be, for example, plastic or any other suitable electrical insulting material. The example first tubular member 24 defines a first exterior surface 30 and a first interior 32 within the first tubular member 24.

Figure 2A:
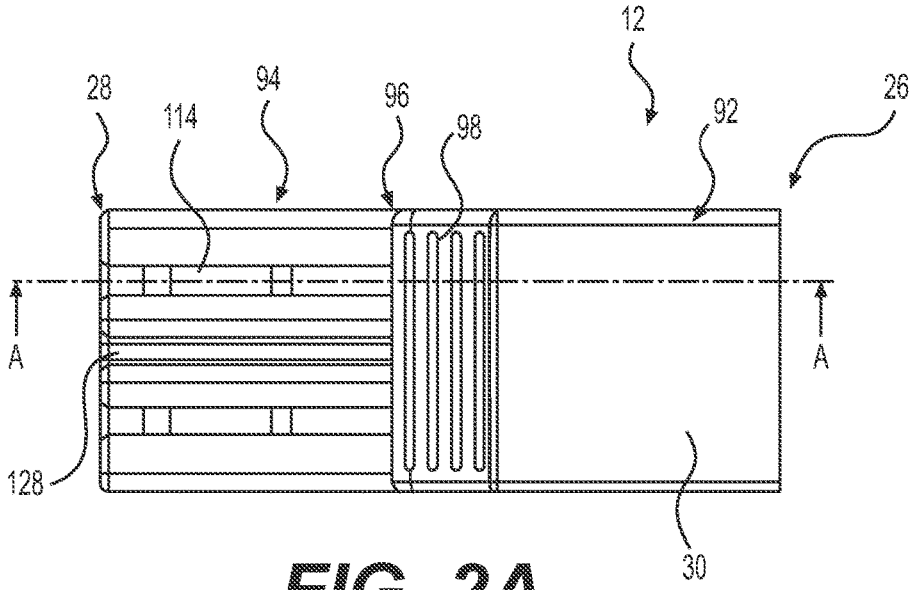
FIG. 2A is a schematic, top view of an example first connector element of the example connector shown in FIGS. 1A-1D.
Figure 2B:
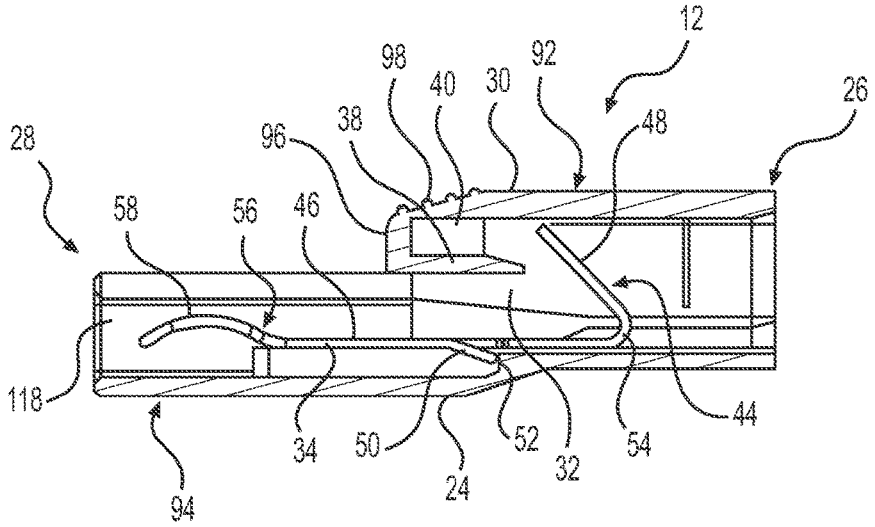
FIG. 2B is a schematic, partial side section view of the example first connector element shown in FIG. 2A taken along line A-A.

In the example shown in FIGS. 1D and 2B, the first connector element 12 also includes a first contact element 34 coupled to the first interior 32 of the first connector element 12. The first contact element 34 may be formed from any electrically conductive material, such as, for example, copper and/or aluminum, or any other suitable electrically conductive material. The first contact element 34 is configured to anchor the first electrical conductor 16 in the first interior 32 and electrically couple the first electrical conductor 16 to the second electrical conductor 18, for example, via a second contact element 36 in the second connector element 14. For example, as shown in FIGS. 1D and 2B, the first interior 32 of the first tubular member 24 includes a first internal flange 38 defining a first pocket 40 configured to receive a remote end 42 of the first electrical conductor 16. As shown, the remote end 42 of the first electrical conductor 16 has been stripped of insulation, thereby facilitating electrical coupling between the first contact element 34 and the remote end 42 of the first electrical conductor 16.

In the example shown, the first contact element 34 includes a first anchor end 44 configured to anchor the first electrical conductor 16 in the first connector element 12 and provide an electrical coupling between the first electrical conductor 16 and the second contact element 36 of the second connector element 14. For example, as shown in FIG. 2B, the first contact element 34 includes a relatively planar first shank 46 terminating in a first return flange 48 and a first anchor barb 50. The first anchor barb 50 projects from the plane of the first shank 46 and engages a first ledge 52 in the first interior 32 of the first tubular member 24. The first return flange 48 is formed by a first bend 54 of the first shank 46 and extends back over the first shank 46 toward the first pocket 40, thereby forming a hook-shaped cross-section. As shown in FIG. 2B, the first anchor end 44 is biased to initially block the passage from the first conductor end 26 of the first connector element 12 to the first pocket 40. As shown in FIG. 1D, the first anchor end 44 is configured to deflect toward the end of the first internal flange 38 when the first electrical conductor 16 is inserted into the first pocket 40, so that the stripped portion of the first electrical conductor 16 is engaged by the end of the first anchor end 44. This example configuration results in securely anchoring the first electrical conductor 16 in the first connector element 12 and providing an electrical coupling between the first electrical conductor 16 and the first contact element 34.

The example first contact element 34 also includes a first contact end 56 configured to electrically couple the first contact element 34 to the second contact element 36 and provide an electrical coupling between the first electrical conductor 16 and the second electrical conductor 18, for example, as shown in FIG. 1D. In the example shown, the first contact end 56 is located at the end of the first shank 46 of the first contact element 34 opposite the first anchor end 44. The example first contact end 56 includes a first contact bend 58 configured to project slightly from the plane defined by the first shank 46 in the same direction as the first anchor end 44. The example first contact bend 58 includes a shallow arc configured to deflect when engaged by the second contact element 36 and provide a secure electrical coupling between the first and second contact elements 34 and 36 when the first connector element 12 and the second connector element 14 are coupled to one another.

Figure 3A:
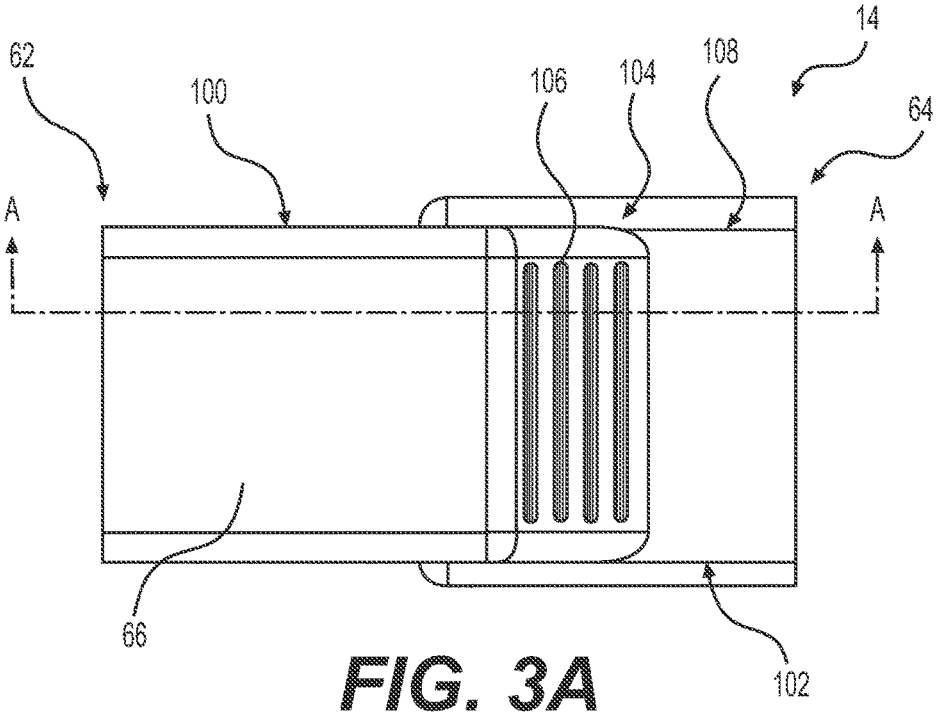
FIG. 3A is a schematic, top view of an example second connector element of the example connector shown in FIGS. 1A-1D.
Figure 3B:
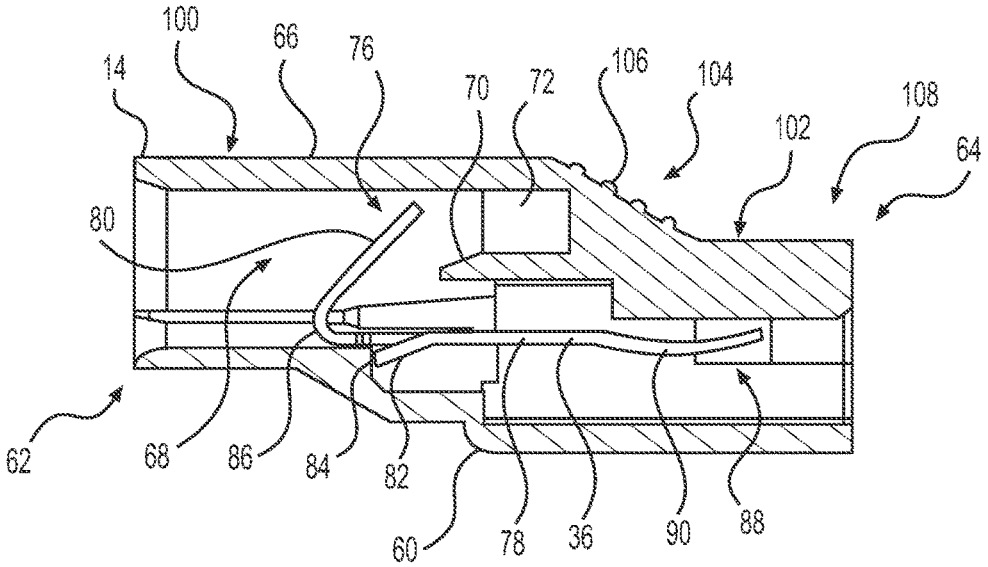
FIG. 3B is a schematic, partial side section view of the example second connector element shown in FIG. 3A taken along line A-A.

As shown in FIGS. 1D and 3B, the example second connector element 14 is a female connector configured to receive the first connector element 12, which is a male connector. In the example shown, the second connector element 14 is configured to receive the second electrical conductor 18 and electrically couple the second electrical conductor 18 to the first electrical conductor 16. The second connector element 14 includes a second tubular member 60 formed from an electrically insulating material and extending longitudinally between a second conductor end 62 configured to receive the second electrical conductor 18 and a second connector end 64 configured to be coupled to the first connector element 12. The electrically insulating material may be, for example, plastic or any other suitable electrical insulting material. The example second tubular member 60 defines a second exterior surface 66 and a second interior 68 within the second tubular member 60.

In the example shown in FIGS. 1D and 3B, the second connector element 14 also includes the second contact element 36 coupled to the second interior 68 of the second connector element 14. The second contact element 36 may be formed from any electrically conductive material, such as, for example, copper and/or aluminum, or any other suitable electrically conductive material. The second contact element 36 is configured to anchor the second electrical conductor 18 in the second interior 68 and electrically couple the second electrical conductor 18 to the first electrical conductor 16, for example, via the first contact element 34 in the first connector element 12. For example, as shown in FIGS. 1D and 3B, the second interior 68 of the second tubular member 60 includes a second internal flange 70 defining a second pocket 72 configured to receive a remote end 74 of the second electrical conductor 18. As shown, the remote end 74 of the second electrical conductor 18 has been stripped of insulation, thereby facilitating electrical coupling between the second contact element 36 and the remote end 74 of the second electrical conductor 18.

In the example shown, the second contact element 36 includes a second anchor end 76 configured to anchor the second electrical conductor 18 in the second connector element 14 and provide an electrical coupling between the second electrical conductor 18 and the first contact element 34 of the first connector element 12. For example, as shown in FIG. 3B, the second contact element 36 includes a relatively planar second shank 78 terminating in a second return flange 80 and a second anchor barb 82. The second anchor barb 82 projects from the plane of the second shank 78 and engages a second ledge 84 in the second interior 68 of the second tubular member 60. The second return flange 80 is formed by a second bend 86 of the second shank 78 and extends back over the second shank 78 toward the second pocket 72, thereby forming a hook-shaped cross-section. As shown in FIG. 3B, the second anchor end 76 is biased to initially block the passage from the second conductor end 62 of the second connector element 14 to the second pocket 72. As shown in FIG. 1D, the second anchor end 76 is configured to deflect toward the end of the second internal flange 70 when the second electrical conductor 18 is inserted into the second pocket 72, so that the stripped portion of the second electrical conductor 18 is engaged by the end of the second anchor end 76. This example configuration results in securely anchoring the second electrical conductor 18 in the second connector element 14 and providing an electrical coupling between the second electrical conductor 18 and the second contact element 36.

The example second contact element 36 also includes a second contact end 88 configured to electrically couple the second contact element 36 to the first contact element 34 and provide an electrical coupling between the second electrical conductor 18 and the first electrical conductor 16, for example, as shown in FIG. 1D. In the example shown, the second contact end 88 is located at the end of the second shank 78 of the second contact element 36 opposite the second anchor end 76. The example second contact end 88 includes a second contact bend 90 configured to project slightly from the plane defined by the second shank 78 in the same direction as the second anchor end 76. The example second contact bend 90 includes a shallow arc configured to deflect when engaged by the first contact bend 58 of the first contact element 34 and provide a secure electrical coupling between the first and second contact elements 34 and 36 when the first connector element 12 and the second connector element 14 are coupled to one another.

Although the section views shown in FIGS. 1D, 2B, and 3B depict only a single pair of the electrical conductors due to the limitations of the views, as noted previously, the connector 10 may electrically couple a plurality of pairs of electrical conductors to one another. For example, as shown in FIG. 1B, a second pair of electrical conductors (i.e., the third and fourth electrical conductors 20 and 22) may be coupled to one another by the first and second connector elements 12 and 14. As noted previously, some examples of the connector 10 may couple more than two pairs of electrical conductors to one another.

As shown in FIGS. 1D, 2A, and 2B, some examples of the first exterior surface 30 of the first connector element 12 define a first body portion 92 and a projection 94 configured to be received by the second connector element 14 (see FIG. 1D). In the example shown, the first body portion 92 and the projection 94 are coupled to one another at a first shoulder 96. In some examples, the first exterior surface 30 defines a plurality of transverse ridges 98 associated with the first shoulder 96, for example, on the first body portion 92 adjacent the first shoulder 96, and configured to facilitate gripping the first connector element 12. For example, the transverse ridges 98 may be perpendicular to the direction of insertion of the projection 94 into the second connector element 14.

As shown in FIGS. 1D, 3A, and 3B, some examples of the second exterior surface 66 of the second connector element 14 define a second body portion 100 and a tubular receiver 102 configured to receive the projection 94 of the first connector element 12. In the example shown, the second body portion 100 and the tubular receiver 102 are coupled to one another at a second shoulder 104. In some examples, the second exterior surface 66 defines a plurality of transverse ridges 106 associated with the second shoulder 104, for example, between the tubular receiver 102 and the second shoulder 104, and configured to facilitate gripping the second connector element 14. The transverse ridges 106 of the second connector element 14 may be perpendicular to the direction of insertion of the projection 94 of the first connector 12 into the tubular receiver 102 of the second connector element 14.

As shown in FIGS. 1A, 1C, and 1D, the first exterior surface 30 of the first connector element 12 and the second exterior surface 66 of the second connector element 14 define a recess 108 between the first shoulder 96 and the second shoulder 104 when the projection 94 of the first connector element 12 is received in the tubular receiver 102 of the second connector element 14. In some configurations, the recess 108 may provide clearance for one or more fingers (or the thumb) from each hand to grasp one of the first and second connector elements 12 and 14 to facilitate pushing them together and/or separating them. The transverse ridges 98 and 106 may assist with providing sufficient grip to apply sufficient force to the first and second connector elements 12 and 14 to push them together and/or separate them.

Figure 2C:
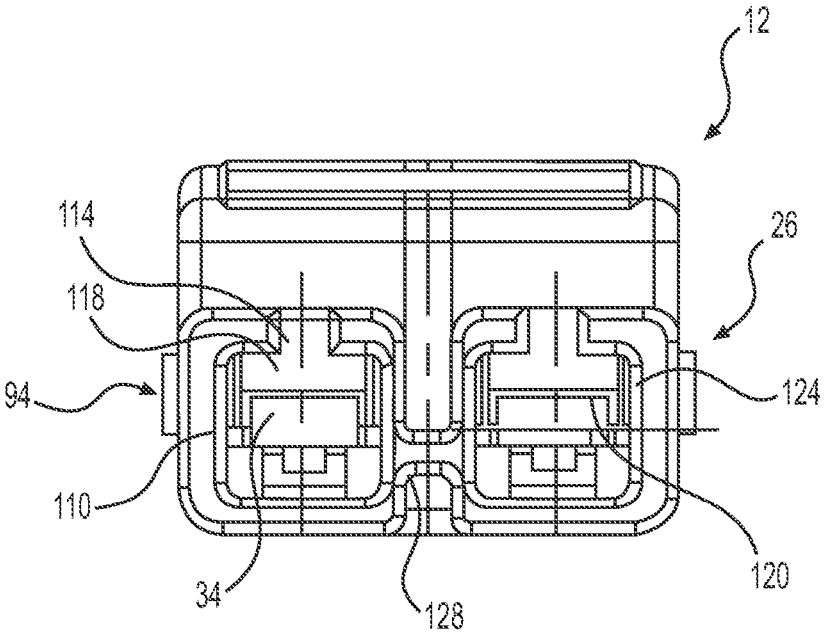
FIG. 2C is a schematic, end view of the example first connector element shown in FIG. 2A.
Figure 3C:
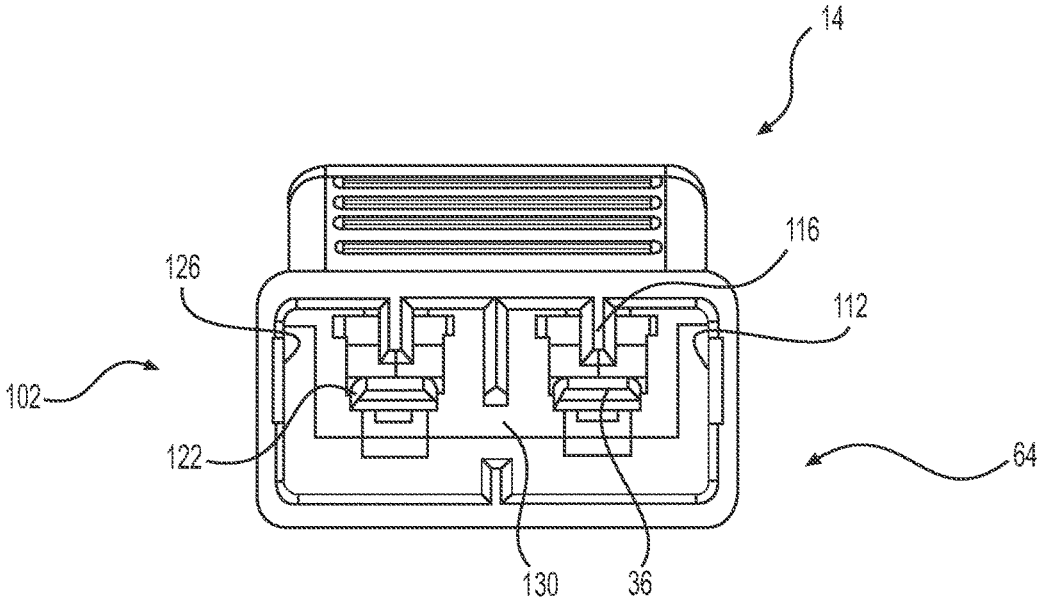
FIG. 3C is a schematic, end view of the example second connector element shown in FIG. 3A.

As shown in FIGS. 2C and 3C, in some examples, the projection 94 of the first connector element 12 defines an exterior cross-section 110, and the tubular receiver 102 of the second connector element 14 defines an interior cross-section 112. The exterior cross-section 110 and the interior cross-section 112 are configured such that the exterior cross-section 110 is received in the interior cross-section 112 when the projection 94 of the first connector element 12 is received in the tubular receiver 102 of the second connector element 14. As shown in FIG. 2C, the example exterior cross-section 110 of the projection 94 defines a longitudinal mating recess 114. As shown in FIG. 3C, the interior cross-section 112 of the tubular receiver 102 defines a longitudinal mating extension 116. In such examples, the mating extension 116 is received in the mating recess 114 when the projection 94 of the first connector element 12 is received in the tubular receiver 102 of the second connector element 14. As noted previously, the first and second connector elements 12 and 14 may be configured to electrically couple two or more pairs of electrical conductors to one another, for example, as shown in FIGS. 1A and 1B. Structures at least similar to the mating recess 114 and the mating extension 116 may be provided for coupling additional pairs of electrical conductors to one another. This example configuration of the mating recess 114 and mating extension 116 may prevent the first and second connector elements 12 and 14 from being coupled to one another in the incorrect orientation relative to one another, which in turn, prevents coupling the incorrect electrical conductors to one another.

In the examples shown, the exterior cross-section 110 of the projection 94 is rectangular (e.g., substantially square), and the interior cross-section 112 of the tubular receiver 102 is rectangular (e.g., substantially square), and the exterior cross-section 110 fits (e.g., snugly) within the interior cross-section 112. For example, as shown in FIGS. 1D, 2B, 2C, 3B, and 3C, the projection 94 of the first connector element 12 defines a tubular interior 118, and the first contact element 34 extends into the tubular interior 118 of the projection 94. The second contact element 36 of the second connector element 14 extends into the interior cross-section 112 of the tubular receiver 102. In this example configuration, the first contact element 34 and the second contact element 36 are electrically coupled to one another when the projection 94 of the first connector element 12 is received in the tubular receiver 102 of the second connector element 14.

Figure 2D:
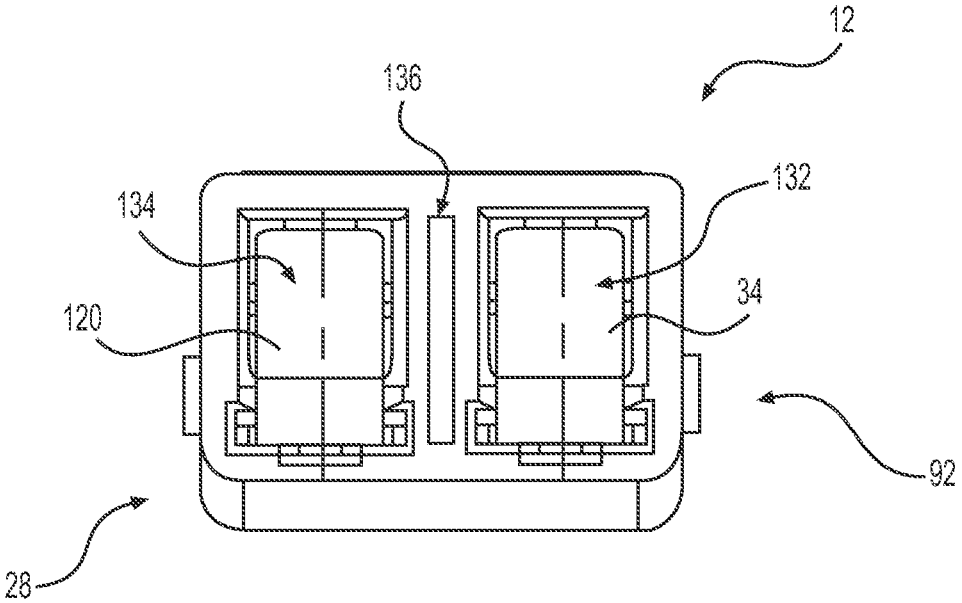
FIG. 2D is a schematic, second end view of the example first connector element shown in FIG. 2A.
Figure 3D:
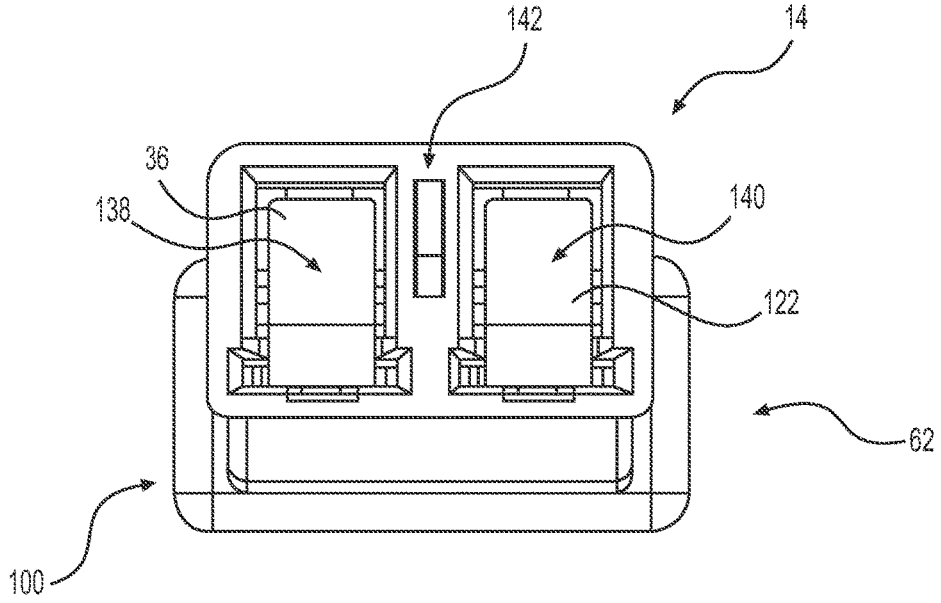
FIG. 3D is a schematic, second end view of the example second connector element shown in FIG. 3A.

In the examples shown, the connector 10 is configured to electrically couple two pairs of electrical conductors to one another. As shown in FIG. 2D, the first connector element 12 further includes a third contact element 120 coupled to the first interior 32 of the first connector element 12. The third contact element 120 is configured to anchor a third electrical conductor 20 in the first interior 32 and electrically couple the third electrical conductor 20 to a fourth electrical conductor 22 associated with the second connector element 14 when the projection 94 of the first connector element 12 is received in the tubular receiver 102 of the second connector element 14. As shown in FIG. 3D, the example second connector element 14 includes a fourth contact element 122 coupled to the second interior 68 of the second connector element 14. The fourth contact element 122 is configured to anchor the fourth electrical conductor 22 in the second interior 68 and electrically couple the fourth electrical conductor 22 to the third electrical conductor 20 when the projection 94 of the first connector element 12 is received in the tubular receiver 102 of the second connector element 14.

In the examples shown in FIGS. 2C and 3C, the projection 94 of the first connector element 12 defines a first exterior cross-section 110 and a second exterior cross-section 124, and the tubular receiver 102 of the second connector element 14 defines a first interior cross-section 112 and a second interior cross-section 126. The first exterior cross-section 110 and the first interior cross-section 112 are configured such that the first exterior cross-section 110 is received in the first interior cross-section 112, and the first contact element 34 of the first connector element 12 and the second contact element 36 of the second connector element 14 are electrically coupled to one another, when the projection 94 of the first connector element 12 is received in the tubular receiver 102 of the second connector element 14. Similarly, the second exterior cross-section 124 and the second interior cross-section 126 are configured such that the second exterior cross-section 124 is received in the second interior cross-section 126, and the third contact element 120 of the first connector element 12 and the fourth contact element 122 of the second connector element 14 are electrically coupled to one another, when the projection 94 of the first connector element 12 is received in the tubular receiver 102 of the second connector element 14. In this example manner, the first electrical conductor 16 and the second electrical conductor 18 are electrically coupled to one another, and the third electrical conductor 20 and the fourth electrical conductor 22 are electrically coupled to one another.

As shown in the examples of FIGS. 2C and 3C, the first exterior cross-section 110 and the second exterior cross-section 124 of the projection 94 of the first connector element 12 are coupled to one another via a longitudinal web 128 extending between the first exterior cross-section 110 and the second exterior cross-section 124. The first interior cross-section 112 and the second interior cross-section 126 of the tubular receiver 102 of the second connector element 14 define a longitudinal passage 130 extending between the first interior cross-section 112 and the second interior cross-section 126. The longitudinal passage 130 is configured receive the longitudinal web 128 when the projection 94 of the first connector element 12 is received in the tubular receiver 102 of the second connector element 14.

In some examples, the longitudinal web 128 provides electrical insulation between the first contact element 34 and the third contact element 120 of the first connector element 12. In some examples, the longitudinal web 128 provides electrical insulation between the second contact element 36 and the fourth contact element 122 of the second connector element 14 when the longitudinal web 128 is received in the longitudinal passage 130. In some examples, for example, as shown in FIG. 2C, the longitudinal web 128 has an hourglass-shaped cross-section. Other cross-sectional shapes are contemplated.

As shown in FIG. 2D, the example first conductor end 26 of the first connector element 12 includes a first conductor receiver 132 configured to receive the first electrical conductor 16, and a third conductor receiver 134 configured to receive the third electrical conductor 20. In the example shown, the first and third conductor receivers 132 and 134 are separated from one another by a first divider 136 configured to assist with separation of the first and third electrical conductors 16 and 20 when they are received in the first conductor end 26 of the first connector element 12. Similarly, as shown in FIG. 3D, the example second conductor end 62 of the second connector element 14 includes a second conductor receiver 138 configured to receive the second electrical conductor 18, and a fourth conductor receiver 140 configured to receive the fourth electrical conductor 22. In the example shown, the second and fourth conductor receivers 138 and 140 are separated from one another by a second divider 142 configured to assist with separation of the second and fourth electrical conductors 18 and 22 when they are received in the second conductor end 62 of the second connector element 14.

In some examples of the connector 10, the first and second connector elements 12 and 14, when coupled to one another, may form a relatively low-profile and streamlined connection for electrically coupled pairs of electrical conductors. For example, as shown in FIGS. 1A-1D, the example connector 10 does not form sharp protrusions or deep grooves that might catch on junction-box openings and/or electrical conduit through which the connector 10 and electrical conductors are pushed or pulled. Such examples of the connector 10 may render it possible to use relatively smaller junction-boxes and/or conduits, and/or may result in more convenient manipulation of the connectors and electrical conductors when electrically connecting various components of an electrical system.

Although this subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A connector configured to connect at least a first electrical conductor and a second electrical conductor to one another, the connector comprising:

a first connector element configured to receive a first electrical conductor and electrically couple the first electrical conductor to a second electrical conductor, the first connector element comprising:

a first tubular member comprising an electrically insulating material and extending longitudinally between a first conductor end configured to receive the first electrical conductor and a first connector end configured to be coupled to a second connector element, the first tubular member defining a first exterior surface and a first interior; and a first contact element coupled to the first interior of the first connector element, the first contact element being configured to anchor the first electrical conductor in the first interior and electrically couple the first electrical conductor to the second electrical conductor, wherein the first exterior surface defines a first body portion and a projection configured to be received by the second connector element, wherein the first body portion and the projection are coupled to one another at a first shoulder, and the first exterior surface defines a plurality of transverse ridges associated with the first shoulder and configured to facilitate gripping the first connector element; and a second connector element configured to receive a second electrical conductor and electrically couple the second electrical conductor to the first electrical conductor, the second connector element comprising:

a second tubular member comprising an electrically insulating material and extending longitudinally between a second conductor end configured to receive the second electrical conductor and a second connector end configured to be coupled to the first connector element, the second tubular member defining a second exterior surface and a second interior; and a second contact element coupled to the second interior of the second connector element, the second contact element being configured to anchor the second electrical conductor in the second interior and electrically couple the second electrical conductor to the first electrical conductor, wherein the second exterior surface defines a second body portion and a tubular receiver configured to receive the projection of the first connector element, wherein the second body portion and the tubular receiver are coupled to one another at a second shoulder, and the second exterior surface defines a plurality of transverse ridges associated with the second shoulder and configured to facilitate gripping the second connector element.

2. The connector of claim 1, wherein the first exterior surface and the second exterior surface define a recess between the first shoulder and the second shoulder when the projection of the first connector element is received in the tubular receiver of the second connector element.

3. The connector of claim 1, wherein the projection of the first connector element defines an exterior cross-section, and the tubular receiver of the second connector element defines an interior cross-section, and wherein the exterior cross-section and the interior cross-section are configured such that the exterior cross-section is received in the interior cross-section when the projection of the first connector element is received in the tubular receiver of the second connector element.

4. The connector of claim 3, wherein the exterior cross-section of the projection defines a longitudinal mating recess, and the interior cross-section of the tubular receiver defines a longitudinal mating extension, and wherein the mating extension is received in the mating recess when the projection of the first connector element is received in the tubular receiver of the second connector element.

5. The connector of claim 3, wherein the exterior cross-section of the projection is rectangular, and the interior cross-section of the tubular receiver is rectangular.

6. The connector of claim 3, wherein the projection of the first connector element defines a tubular interior, and wherein the first contact element extends into the tubular interior of the projection.

7. The connector of claim 6, wherein the second contact element of the second connector element extends into the interior cross-section of the tubular receiver, and wherein the first contact element and the second contact element are electrically coupled to one another when the projection of the first connector element is received in the tubular receiver of the second connector element.

8. The connector of claim 1, wherein the first connector element further comprises a third contact element coupled to the first interior of the first connector element, the third contact element being configured to anchor a third electrical conductor in the first interior and electrically couple the third electrical conductor to a fourth electrical conductor associated with the second connector element when the projection of the first connector element is received in the tubular receiver of the second connector element.

9. The connector of claim 8, wherein the second connector element further comprises a fourth contact element coupled to the second interior of the second connector element, the fourth contact element being configured to anchor a fourth electrical conductor in the second interior and electrically couple the fourth electrical conductor to the third electrical conductor when the projection of the first connector element is received in the tubular receiver of the second connector element.

10. The connector of claim 9, wherein the projection of the first connector element defines a first exterior cross-section and a second exterior cross-section, and the tubular receiver of the second connector element defines a first interior cross-section and a second interior cross-section, wherein the first exterior cross-section and the first interior cross-section are configured such that the first exterior cross-section is received in the first interior cross-section, and the first contact element of the first connector element and the second contact element of the second connector element are electrically coupled to one another, when the projection of the first connector element is received in the tubular receiver of the second connector element, and wherein the second exterior cross-section and the second interior cross-section are configured such that the second exterior cross-section is received in the second interior cross-section, and the third contact element of the first connector element and the fourth contact element of the second connector element are electrically coupled to one another, when the projection of the first connector element is received in the tubular receiver of the second connector element.

11. The connector of claim 10, wherein the first exterior cross-section and the second exterior cross-section of the projection of the first connector element are coupled to one another via a longitudinal web extending between the first exterior cross-section and the second exterior cross-section.

12. The connector of claim 11, wherein the first interior cross-section and the second interior cross-section of the tubular receiver of the second connector element define a longitudinal passage extending between the first interior cross-section and the second interior cross-section, wherein the longitudinal passage is configured receive the longitudinal web when the projection of the first connector element is received in the tubular receiver of the second connector element.

13. The connector of claim 11, wherein the longitudinal web provides electrical insulation between the first contact element and the third contact element of the first connector element.

14. The connector of claim 13, wherein the longitudinal web provides electrical insulation between the second contact element and the fourth contact element of the second connector element when the longitudinal web is received in the longitudinal passage.

15. The connector of claim 13, wherein the longitudinal web has an hourglass-shaped cross-section.

16. A connector configured to connect at least a first electrical conductor and a second electrical conductor to one another, and connect at least a third electrical conductor and a fourth electrical conductor to one another, the connector comprising:

a first connector element configured to receive a first electrical conductor and a third electrical conductor, and electrically couple the first electrical conductor to a second electrical conductor and electrically couple the third electrical conductor to a fourth electrical conductor, the first connector element comprising:

a first tubular member comprising an electrically insulating material and extending longitudinally between a first conductor end configured to receive the first and third electrical conductors, and a first connector end configured to be coupled to a second connector element, the first tubular member defining a first exterior surface and a first interior;

a first contact element coupled to the first interior of the first connector element, the first contact element being configured to anchor the first electrical conductor in the first interior and electrically couple the first electrical conductor to the second electrical conductor; and a third contact element coupled to the first interior of the first connector element, the third contact element being configured to anchor the third electrical conductor in the first interior and electrically couple the third electrical conductor to the fourth electrical conductor, wherein the first exterior surface defines a first body portion and a projection configured to be received by the second connector element; and a second connector element configured to receive a second electrical conductor and a fourth electrical conductor, and electrically couple the second electrical conductor to the first electrical conductor and electrically couple the fourth electrical conductor to the third electrical conductor, the second connector element comprising:

a second tubular member comprising an electrically insulating material and extending longitudinally between a second conductor end configured to receive the second and fourth electrical conductors, and a second connector end configured to be coupled to the first connector element, the second tubular member defining a second exterior surface and a second interior;

a second contact element coupled to the second interior of the second connector element, the second contact element being configured to anchor the second electrical conductor in the second interior and electrically couple the second electrical conductor to the first electrical conductor; and a fourth contact element coupled to the second interior of the second connector element, the fourth contact element being configured to anchor the fourth electrical conductor in the second interior and electrically couple the fourth electrical conductor to the third electrical conductor, wherein the projection of the first connector element defines a first exterior cross-section and a second exterior cross-section, and the tubular receiver of the second connector element defines a first interior cross-section and a second interior cross-section, wherein the first exterior cross-section and the first interior cross-section are configured such that the first exterior cross-section is received in the first interior cross-section, and the first contact element of the first connector element and the second contact element of the second connector element are electrically coupled to one another, when the projection of the first connector element is received in the tubular receiver of the second connector element, wherein the second exterior cross-section and the second interior cross-section are configured such that the second exterior cross-section is received in the second interior cross-section, and the third contact element of the first connector element and the fourth contact element of the second connector element are electrically coupled to one another, when the projection of the first connector element is received in the tubular receiver of the second connector element, and wherein the first exterior cross-section and the second exterior cross-section of the projection of the first connector element are coupled to one another via a longitudinal web extending between the first exterior cross-section and the second exterior cross-section.

17. The connector of claim 16, wherein the first interior cross-section and the second interior cross-section of the tubular receiver of the second connector element define a longitudinal passage extending between the first interior cross-section and the second interior cross-section, wherein the longitudinal passage is configured receive the longitudinal web when the projection of the first connector element is received in the tubular receiver of the second connector element.

18. The connector of claim 16, wherein the longitudinal web provides electrical insulation between the first contact element and the third contact element of the first connector element.

19. The connector of claim 18, wherein the longitudinal web provides electrical insulation between the second contact element and the fourth contact element of the second connector element when the longitudinal web is received in the longitudinal passage.

20. A connector element configured to receive a first electrical conductor and a third electrical conductor, and electrically couple the first electrical conductor to a second electrical conductor and electrically couple the third electrical conductor to a fourth electrical conductor, the connector element comprising:

a tubular member comprising an electrically insulating material and extending longitudinally between a conductor end configured to receive the first and third electrical conductors, and a connector end configured to be coupled to a second connector element, the tubular member defining an exterior surface and an interior;

a first contact element coupled to the interior of the connector element, the first contact element being configured to anchor the first electrical conductor in the interior and electrically couple the first electrical conductor to the second electrical conductor; and a second contact element coupled to the interior of the connector element, the second contact element being configured to anchor the third electrical conductor in the interior and electrically couple the third electrical conductor to the fourth electrical conductor, wherein the exterior surface defines a body portion and a projection configured to be received by the second connector element, wherein the projection of the connector element defines a first exterior cross-section and a second exterior cross-section, and wherein the first exterior cross-section and the second exterior cross-section of the projection of the connector element are coupled to one another via a longitudinal web extending between the first exterior cross-section and the second exterior cross-section.

21. The connector element of claim 20, wherein the longitudinal web provides electrical insulation between the first contact element and the second contact element of the connector element.

22. The connector element of claim 20, wherein the longitudinal web has an hourglass-shaped cross-section.

23. The connector of claim 20, wherein the body portion and the projection are coupled to one another at a shoulder, and the exterior surface defines a plurality of transverse ridges associated with the shoulder and configured to facilitate gripping the connector element.

24. A connector element configured to receive a first electrical conductor and a third electrical conductor, and electrically couple the first electrical conductor to a second electrical conductor and electrically couple the third electrical conductor to a fourth electrical conductor, the connector element comprising:

a tubular member comprising an electrically insulating material and extending longitudinally between a conductor end configured to receive the first and third electrical conductors, and a connector end configured to be coupled to a second connector element, the tubular member defining an exterior surface and an interior;

a first contact element coupled to the interior of the connector element, the first contact element being configured to anchor the first electrical conductor in the interior and electrically couple the first electrical conductor to the second electrical conductor; and a second contact element coupled to the interior of the connector element, the second contact element being configured to anchor the third electrical conductor in the interior and electrically couple the third electrical conductor to the fourth electrical conductor, wherein the exterior surface defines a body portion and a tubular receiver configured to receive a projection from the second connector element, wherein the tubular receiver defines a first interior cross-section and a second interior cross-section, and wherein the first interior cross-section and the second interior cross-section of the tubular receiver define a longitudinal passage extending between the first interior cross-section and the second interior cross-section.

* * * * *